US007065312B2

(12) United States Patent
Sasoh et al.

(10) Patent No.: US 7,065,312 B2
(45) Date of Patent: Jun. 20, 2006

(54) CABINET OPENING STRUCTURE AND IMAGE FORMING APPARATUS

(75) Inventors: Kiyoshi Sasoh, Nara (JP); Tatsuya Inoue, Nara (JP); Kouji Wakamoto, Nara (JP); Masao Matsui, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 141 days.

(21) Appl. No.: 10/808,511

(22) Filed: Mar. 25, 2004

(65) Prior Publication Data

US 2004/0190940 A1 Sep. 30, 2004

(30) Foreign Application Priority Data

Mar. 27, 2003 (JP) ..... P2003-087653

(51) Int. Cl.
*G03G 15/00* (2006.01)

(52) U.S. Cl. ..... 399/124; 271/273; 399/107

(58) Field of Classification Search ..... 399/124, 399/125, 107, 110, 122
See application file for complete search history.

(56) References Cited

U.S. PATENT DOCUMENTS 4,903,076 A * 2/1990 Sakakibara ..... 399/124
5,280,898 A * 1/1994 Nakano et al. ..... 271/273 X
6,075,958 A * 6/2000 Gotoh et al. ..... 399/124
6,145,828 A * 11/2000 Arai ..... 271/273 X
2002/0054777 A1* 5/2002 Itoh et al. ..... 399/401
2004/0161259 A1* 8/2004 Murakami et al. ..... 399/110
2004/0190939 A1* 9/2004 Yamanaka ..... 399/122

FOREIGN PATENT DOCUMENTS

JP 58-153976 A * 9/1983
JP 03-006584 A * 1/1991
JP 04-095985 A * 3/1992
JP 06-144635 A * 5/1994
JP 10-254205 A * 9/1998
JP 11-160948 A 6/1999
JP 2002-274693 A 9/2002

* cited by examiner

*Primary Examiner*—Sophia S. Chen
(74) *Attorney, Agent, or Firm*—Birch, Stewart, Kolasch & Birch, LLP

(57) ABSTRACT

An image forming apparatus includes, for example, a first knob serving as a first operating member for manually turning a registration roller member in a sheet transporting unit and a second knob serving as a second operating member for manually turning a fixing roller in a fixing device. The first and second operating devices, such as knobs, are provided in such a manner as to be exposed onto a side of the apparatus body facing a direction perpendicular to a direction in which the cabinet may be opened.

16 Claims, 5 Drawing Sheets

CABINET OPENING STRUCTURE AND IMAGE FORMING APPARATUS

CROSS REFERENCE

This Nonprovisional application claims priority under 35 U.S.C. § 119(a) on Patent Application No. 2003-087653 filed in Japan on Mar. 27, 2003, the entire contents of which are hereby incorporated by reference.

BACKGROUND OF THE INVENTION

The present invention relates to a cabinet opening structure in a mechanical apparatus provided with a sheet member transporting unit and, more particularly, to an image forming apparatus such as a printer, a facsimile and a copying machine having the above-described opening structure.

In an image forming apparatus such as a copying machine or a printer, a sheet member (i.e., a sheet of paper) is supplied to an image forming unit from a sheet supplying tray disposed at a lower portion inside of the apparatus via a transportation path. The sheet supplying tray is adapted to previously contain therein the sheet member for use in image formation. In the sheet supplying tray are normally contained the standard-sized sheet members frequently used, on which an image is easily formed and which is favorably transported.

After the image formation in the image forming unit, the sheet member is discharged outside of the image forming apparatus. In recent years, the complexity of the image forming apparatus has increased, and it is desirable that the image forming apparatus should have the functions of a copying machine, a printer, a facsimile and the like in combination, and that the sheet members to be discharged should be classified according to the image forming function, thereby obtaining an image forming system easy to be used. In order to achieve such an image forming system, for example, there has been proposed an image forming apparatus configured such that discharge ports, through which the sheet member in the image forming unit is discharged outside of the image forming apparatus via the transportation path, are disposed on both sides of the apparatus body, thereby facilitating the classification of the sheet members.

Furthermore, the image forming apparatus has been made to cope with space saving by reducing the size of the image forming apparatus or an area occupied for installation. Therefore, the transportation path in the image forming unit in the image forming apparatus is changed from a lateral orientation to a longitudinal or vertical orientation. Thus, the number of image forming apparatuses having the transportation path of the longitudinal or vertical orientation has become increased in recent years.

In this manner, in the case where the transportation path in the image forming unit is oriented longitudinally, there can be configured a short transportation path for transporting the sheet member to the image forming unit from a sheet supplying device disposed at the lower portion in the image forming apparatus. Moreover, there is an advantage of efficient arrangement of the sheet supplying device, a sheet discharging tray unit for classifying the sheet members and stacking them thereon, a post-processing device and the like.

However, since the transportation path is formed near a side surface, an access must be made to the image forming apparatus not in front of the image forming apparatus but from the side surface thereof in the case where the sheet member is jammed on the transportation path. Therefore, such a trouble is solved by opening a side cabinet in many cases.

In the conventional image forming apparatus, when operation is carried out in the above-described manner in the state in which the side cabinet is opened, a recovery operation such as jamming processing for taking out and removing a sheet member jammed on the transportation path is performed by rotating an operating member such as a knob for turning transporting means such as a transporting roller or a fixing roller housed inside of a frame in an image forming unit after the side cabinet is opened (see, for example, paragraphs [0050] and [0052] and FIGS. 3 and 5 in the specification of JP-A No. 2002-274693).

Moreover, in the case where the front cabinet is first opened when the recovery operation is carried out, the recovery operation cannot be carried out. Therefore, the fact is notified that the recovery operation cannot be carried out unless the side cabinet also is opened, for example, when the front cabinet is opened (see, for example, paragraphs [0011] and [0012] and FIG. 3 in the specification of JP-A No. 11-160948).

However, in the image forming apparatus disclosed in JP-A No. 2002-274693, since the operation for taking out the jammed sheet member from the transportation path by operating the operating member such as the knob disposed inside of the apparatus body after the side cabinet is opened is performed from a position in front of the image forming apparatus, it has been difficult to find the knob or the like disposed inside of the apparatus body, and further, the operation has not been easy.

In contrast, as disclosed in JP-A No. 11-160948, in the case where the knob or the like is operated in front of the image forming apparatus, the front cabinet must be opened owing to the relationship of a position at which the knob is disposed (i.e., a position of a transporting roller member which must be rotated) and therefore, both of the front cabinet and the side cabinet must be opened. In other words, since two operations must be performed, considerable work has been required for the recovery operation.

SUMMARY OF THE INVENTION

A cabinet opening structure according to an embodiment of the present invention comprises: a cabinet having an openable portion which can be opened from an apparatus body in the apparatus provided with a transporting unit for transporting a sheet member; and an operating member, which is connected to the transporting unit, can be manually operated, and is operated when the sheet member is taken out of the inside of the apparatus body; wherein the operating member is disposed at a position, at which the operating member is exposed to the outside of the apparatus body in a direction perpendicular to the opening direction when the openable portion of the cabinet is opened from the apparatus body.

With this configuration, when a recovery operation is carried out by taking out the jammed sheet member in the case where the sheet member accidentally stays inside of the apparatus body due to transportation jamming or the like, the operating member is exposed in front of an operator who carries out the recovery operation if the openable portion of the cabinet perpendicular to the side facing to the apparatus body is opened by the operator. In this manner, the operating member can be readily operated. Moreover, even if the operator opens the openable portion forward at a position facing to the openable portion of the cabinet, the operating member is not concealed by the openable portion but exposed to the outside of the apparatus body in a direction perpendicular to the opening direction, so that the operator can easily operate the operating member.

In the above-described configuration, the openable portion of the cabinet may be disposed on a side perpendicular to the front surface of the apparatus body, at which an apparatus operating unit for operating the apparatus body is provided, and further, the operating member may be exposed onto the side of the operating unit of the apparatus body, at which the apparatus operating unit is provided.

Furthermore, the openable portion of the cabinet may be configured in such a manner as to include a part of the cabinet on the side of the operating unit.

An image forming apparatus according to an embodiment of the present invention comprises: a transporting unit for transporting a sheet member; an image forming unit for forming an image on the sheet member based on image information; a fixing device for fixing the image formed on the sheet member in the image forming unit; a cabinet having an openable portion which can be opened from an apparatus body; a first operating member, which is connected to the transporting unit, which can be manually operated, and is operated when the sheet member is taken out of the inside of the apparatus body; and a second operating member, which is connected to the fixing device, which can be manually operated, and is operated when the sheet member is taken out of the inside of the apparatus body; wherein the first and second operating members are disposed at positions, at which the operating members are exposed to the outside of the apparatus body in a direction perpendicular to the opening direction when the openable portion of the cabinet is opened from the apparatus body, in the proximity of an end of a frame member in the apparatus body along a transportation direction of the sheet member.

In the above-described configuration, the transporting unit may include a registration roller pair for controlling a timing when the sheet member is transported with respect to the image forming unit; the fixing device includes a fixing roller for holding the sheet member with the application of heat under pressure so as to fix the image formed on the sheet member; and the first operating member may be connected to the registration roller pair in the transporting unit while the second operating member may be connected to the fixing roller in the fixing device.

In the image forming apparatus having the above-described configuration, when the recovery operation is carried out by taking out the jammed sheet member in the case where the sheet member accidentally stays inside of the apparatus due to transportation jamming or the like, the first and second operating members can be easily operated since the operating members are provided in front of the operator even if the openable portion of the cabinet is on a side perpendicular to the side facing the operator who carries out the recovery operation. The registration roller pair for transporting the sheet member while holding the sheet member by strong force and the fixing roller can be manually driven independently of each other by operating the first and second operating members, thereby readily taking out the sheet recording member staying inside of the image forming apparatus due to the trouble such as the transportation jamming.

DETAILED DESCRIPTION OF THE INVENTION

A description will be given below of a cabinet opening structure and an image forming apparatus having the structure in a preferred embodiment according to the present invention.

Figure 1:
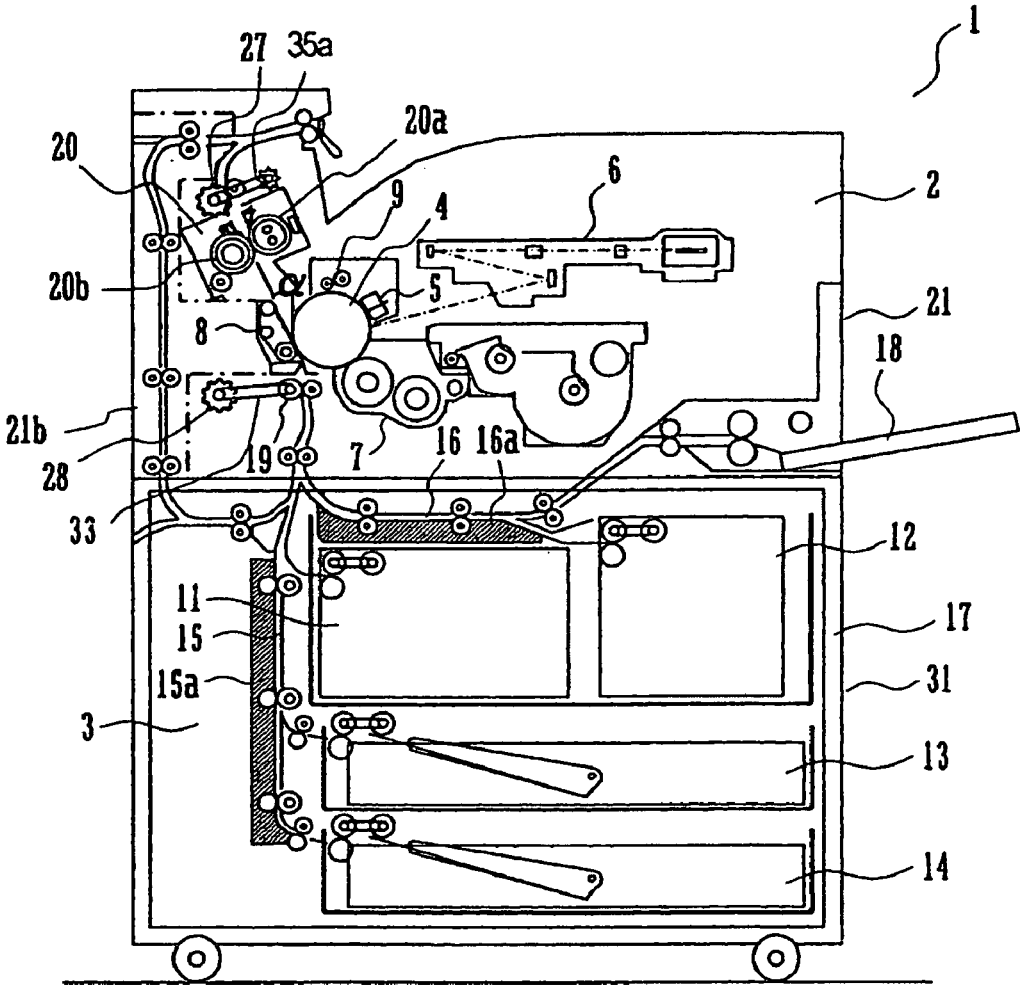
FIG. 1 is a view showing the configuration of an image forming apparatus in a preferred embodiment according to the present invention.

FIG. 1 is a view showing the configuration of an image forming apparatus 1. The image forming apparatus 1 is provided with a printer unit (i.e., an image forming unit) 2 and a sheet supplying unit 3 disposed under the printer unit 2. At substantially the center of the printer unit 2 is arranged an electrophotographic processing unit including mainly a photosensitive drum 4. Specifically, around the photosensitive drum 4 are arranged a charging unit 5, an optical scanning unit 6, a developing unit 7, a transferring unit 8 and a cleaning unit 9. On the downstream side of the photosensitive drum 4 is disposed a fixing unit 20 for fixing a transferred image onto a sheet (i.e., a sheet member) with the application of heat under pressure.

The charging unit 5 is adapted to uniformly charge the surface of the photosensitive drum 4. The optical scanning unit 6 is adapted to scan an optical image on the uniformly charged photosensitive drum 4, so as to write an electrostatic latent image on the photosensitive drum 4. The developing unit 7 is adapted to develop the electrostatic latent image written by the optical scanning unit 6 with a developer. The transferring unit 8 is adapted to transfer an image, which is recorded and reproduced on the photosensitive drum 4, onto a recording medium.

The cleaning unit 9 is adapted to remove the developer remaining on the photosensitive drum 4, so as to record a new image on the photosensitive drum 4. The remaining developer removed by the cleaning unit 9 is recovered to a developer supplying unit 10 in the developing unit 7, to be then recycled. Incidentally, the image forming apparatus 1 according to the present invention is not limited to a type including a process for recycling the remaining developer, but it may include an image forming apparatus, in which a developer is recovered and discarded.

Subsequently, explanation will be made on the sheet supplying unit 3. The sheet supplying unit 3 includes a plurality of sheet supplying trays (i.e., recording medium supplying units) 11, 12, 13 and 14. Since the sheet supplying unit 3 includes these sheet supplying trays 11 to 14, the sheet supplying unit 3 can classify and contain various kinds of sheets serving as the recording mediums, for example, per size.

The image forming apparatus 1 selects one of the sheet supplying trays 11 to 14, and further, separates the sheets one by one from the selected sheet supplying tray, and then, supplies them between the photosensitive drum 4 and the transferring unit 8. Thereafter, the transferring unit 8 transfers, to the supplied sheet, the recorded and reproduced image onto the photosensitive drum 4.

Here, more specific explanation will be made on the sheet supplying trays 11 to 14. The sheet supplying tray (i.e., a first recording medium supplying unit) 11 and the sheet supplying tray (i.e., a second recording medium supplying unit) 12 are arranged in parallel to each other. The sheet supplying tray 13 is arranged under the sheet supplying tray 11 and the sheet supplying tray 12, and further, the sheet supplying tray 14 is arranged under the sheet supplying tray 13.

The sheet supplying trays 13 and 14 have substantially the same capacity. Each of the sheet supplying trays 11 and 12 has a capacity greater than that of the sheet supplying tray 13 or 14.

The sheet supplying unit 3 includes a first transportation path 15 and a second transportation path 16 in order to transport the sheets contained in the sheet supplying trays 11 to 14 toward the printer unit 2. Incidentally, the first transportation path 15 is adapted to transport the sheets contained in the sheet supplying trays 11, 13 and 14 toward the printer unit 2 and the second transportation path 16 is adapted to transport the sheets contained in the sheet supplying tray 12 toward the printer unit 2.

Moreover, the first transportation path 15 extends in a vertical direction in the sheet supplying unit 3. In contrast, the second transportation path 16 extends in a horizontal direction. Consequently, the sheet supplying trays 11 to 14, the first transportation path 15 and the second transportation path 16 are efficiently arranged inside of the sheet supplying unit 3, thereby saving the space of the sheet supplying unit 3. In the case where the sheets are stacked in each of the sheet supplying trays 11 to 14, a target one of the sheet supplying trays 11 to 14 is withdrawn out forward in the main body of the image forming apparatus 1, and then, sheets are replenished.

If the sheet is jammed on the first transportation path 15, a guide 15*a* (indicated by cross hatching in FIG. 1) constituting the first transportation path 15 pivoted away from opposing rollers using the back side of the sheet supplying unit 3 as a fulcrum. In this manner, the sheet jammed on the first transportation path 15 can be removed. Incidentally, the jammed sheet is removed by utilizing a work space previously defined between the first transportation path 15 and the frame 17.

In contrast, if the sheet is jammed on the second transportation path 16, a guide 16*a* (indicated by cross hatching in FIG. 1) constituting the second transportation path 16 is pivoted away from opposing rollers using the back side of the sheet supplying unit 3 as a fulcrum. In this manner, the sheet jammed on the second transportation path 16 can be removed. Incidentally, the removing work (i.e., recovering operation) is carried out by withdrawing the sheet supplying trays 11 and 12 arranged in parallel to each other forward of the user so as to secure the work space under the second transportation path 16.

Although the present preferred embodiment is configured such that the sheet supplying trays 11 and 12 can be withdrawn out at the same time, the present invention is not always limited to the above-described configuration, but each of the sheet supplying trays may be withdrawn independently of each other. In such a case, the work space for removing the sheet jammed on the second transportation path 16 may be secured under the second transportation path 16 by withdrawing the sheet supplying tray 11 forward.

On the upstream side of the second transportation path 16 is disposed a manually sheet supplying unit (i.e., a third recording medium supplying unit) 18, in which sheets are set in a relatively small quantity. Special sheets are possibly set in the manually sheet supplying unit 18. The sheets can be readily replaced or set in the manually sheet supplying unit 18. Moreover, another sheet supplying unit (i.e., a fourth recording medium supplying unit) may be connected to the right side of the sheet supplying unit 3, although not shown.

A registration roller pair 19 for controlling the corresponding position of a sheet recording medium with respect to the image formed on the photosensitive drum 4 is located upstream in a transportation direction of the photosensitive drum 4 in the printer unit 2. The registration roller member 19 is adapted to temporarily stop the sheet being supplied to the printer unit 2, thus causing the sheet to bend as a result of being pushed against the registration rollers. Consequently, it is possible to correct the inclination of the sheet, which may be inclined during the transportation to the registration roller pair 19, and the sheet is started at a timing of an image to be formed on the photosensitive drum 4 in response to a signal output from a control unit, not shown. Thus, the image is transferred at a proper position on the sheet. As a consequence, a strong abutting force (i.e., a strong holding force) is applied to the registration roller pair 19, thereby preventing the sheet from getting into the registration roller pair 19 during the bending of the sheet when the inclination of the sheet is corrected. The holding force is set to 1.5 kg to 3 kg.

The fixing unit 20 is adapted to fix the image transferred onto the sheet with the application of the heat under the pressure. The fixing unit 20 includes transporting means consisting of a fixing roller 20*a* containing therein a heat generator such as a heater lamp and a pressurizing roller 20*b* for transporting the sheet while pressing the sheet against the fixing roller 20*a*. The pressurizing roller 20*b* is pressed against the fixing roller 20*a*, which is driven to be rotated, by strong force. The pressurizing force is set to 60 kg to 85 kg. The fixing roller 20*a* is controlled in response to a signal output from a temperature detector for detecting the temperature at the surface of the roller by a control unit, not shown, in such a manner as to be kept at a predetermined surface temperature.

Figure 2:
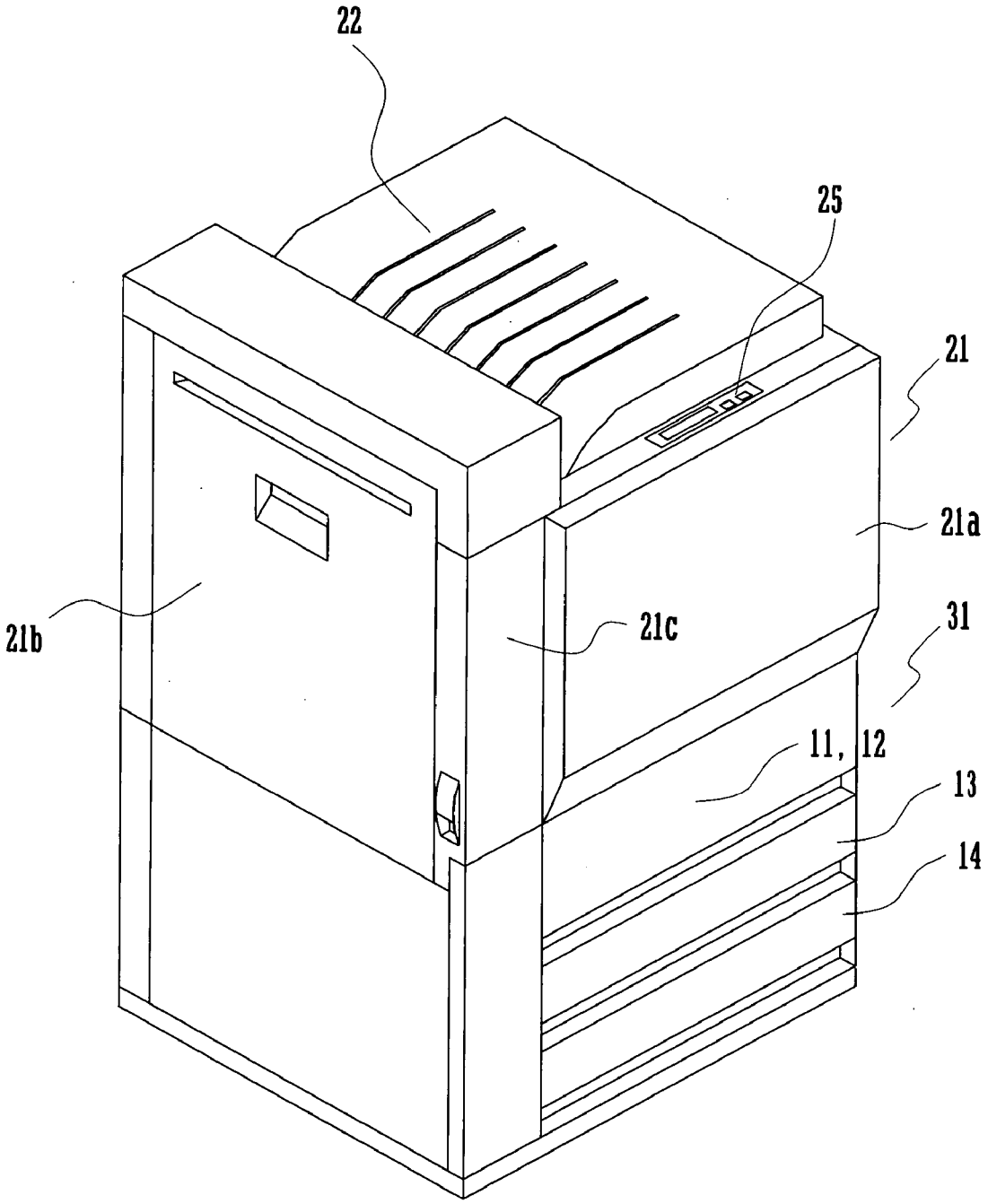
FIG. 2 is a perspective view showing the image forming apparatus.

A cabinet in the image forming apparatus 1 is constituted of a cabinet 21 in the printer unit (i.e., the image forming unit) 2 and another cabinet 31 in the sheet supplying unit 3 located under the printer unit 2. As shown in FIG. 2, at the upper surface of the cabinet 21 in the printer unit 2 is disposed a sheet discharging tray 22. At the front portion of the sheet discharging tray 22 is disposed an operating unit 25 for operating the operation of the image forming apparatus 1.

Figure 3:
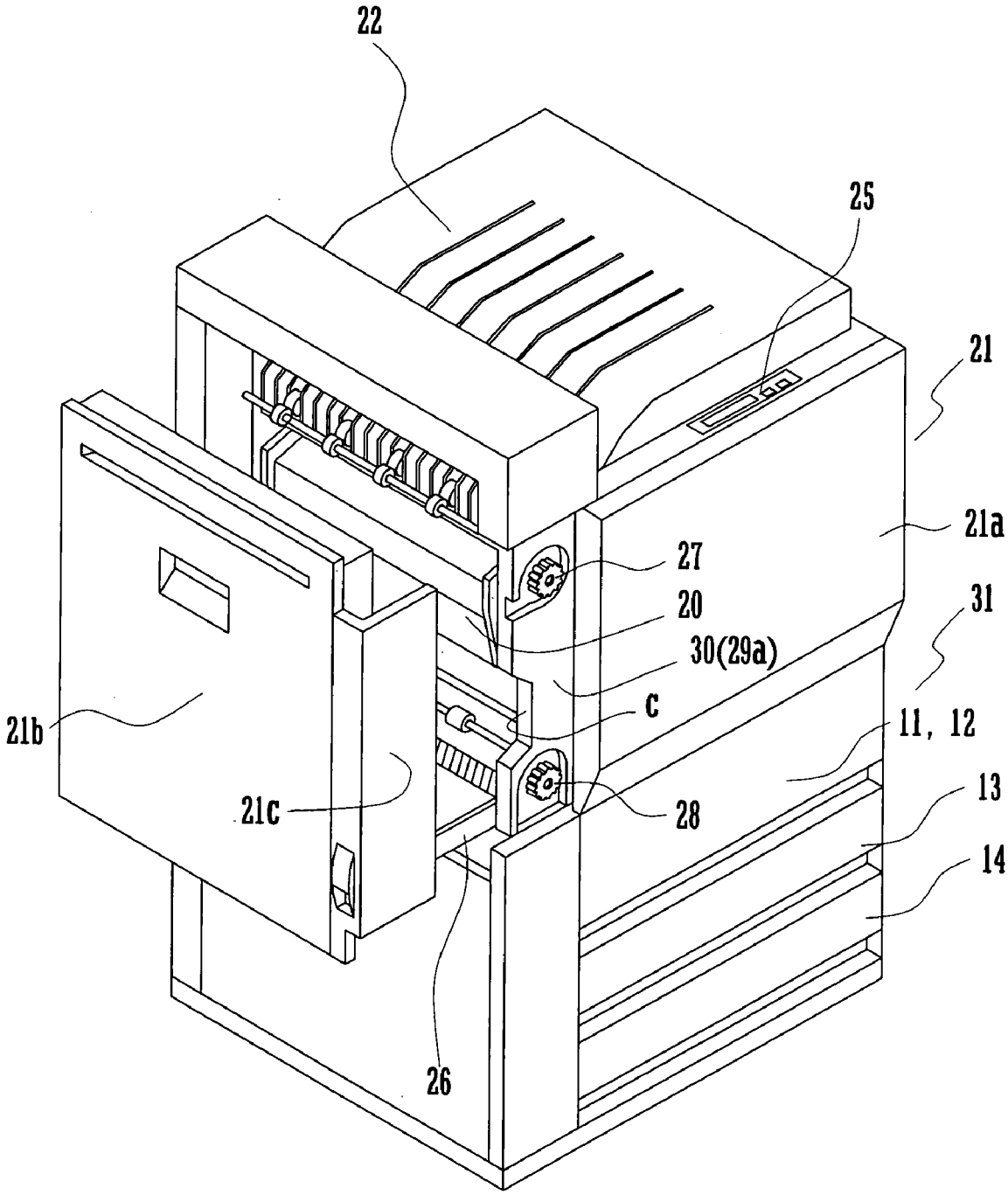
FIG. 3 is a perspective view showing a state in which a cabinet in the image forming apparatus is opened.

A front cabinet 21*a* in the cabinet 21 in the above-described printer unit (the image forming unit) 2 is securely fixed to a frame of the apparatus body. In contrast, a side cabinet (i.e., an openable portion according to the present invention) 21*b* is integrated with a lengthwise pair of rail members 26, which are guided in substantially a horizontal direction by guide members, not shown, disposed in the frame of the apparatus body in the event of jamming or maintenance, as shown in FIG. 3, and further, is configured such that it can be withdrawn (i.e., opened) leftward, as shown in FIG. 3.

Incidentally, a portion opened together with the side cabinet 21*b* is surrounded by alternate long and short dashed lines in FIG. 1. Moreover, the lower portion of the side cabinet 21*b* may be turnably pivoted on the frame of the apparatus body while the upper portion thereof may be opened outward, although the illustration will be omitted. Furthermore, the openable portion is not limited to the side cabinet 21*b* shown in FIGS. 2 to 4, but it may be appropriately selected and set according to the type of apparatus.

A knob 28 (a first operating member according to the illustrated embodiment of the present invention) and a knob 27 (a second operating member according to the illustrated embodiment of the present invention) are provided at a front frame member 29*a* in the apparatus body such that they are exposed to the front of the apparatus body toward a direction perpendicular to the withdrawing direction when the side cabinet 21*b* is withdrawn while they are concealed by a front flange 21*c* of the side cabinet 21*b* when the side cabinet 21*b* is closed with respect to the apparatus body.

The two knobs 27 and 28 are arranged separately from each other upstream and downstream along the vertical transportation path in the image forming apparatus 1. At the intermediate portion of the front frame member 29*a* for supporting the two knobs 27 and 28 thereon, there is formed a cutout c, which is largely cut out, together with a cover member 30 covering the outside thereof, thereby achieving a structure in which a hand can be readily put into the image forming apparatus 1 at the time of the jamming processing (i.e., the recovery operation) or the like.

Figure 4:
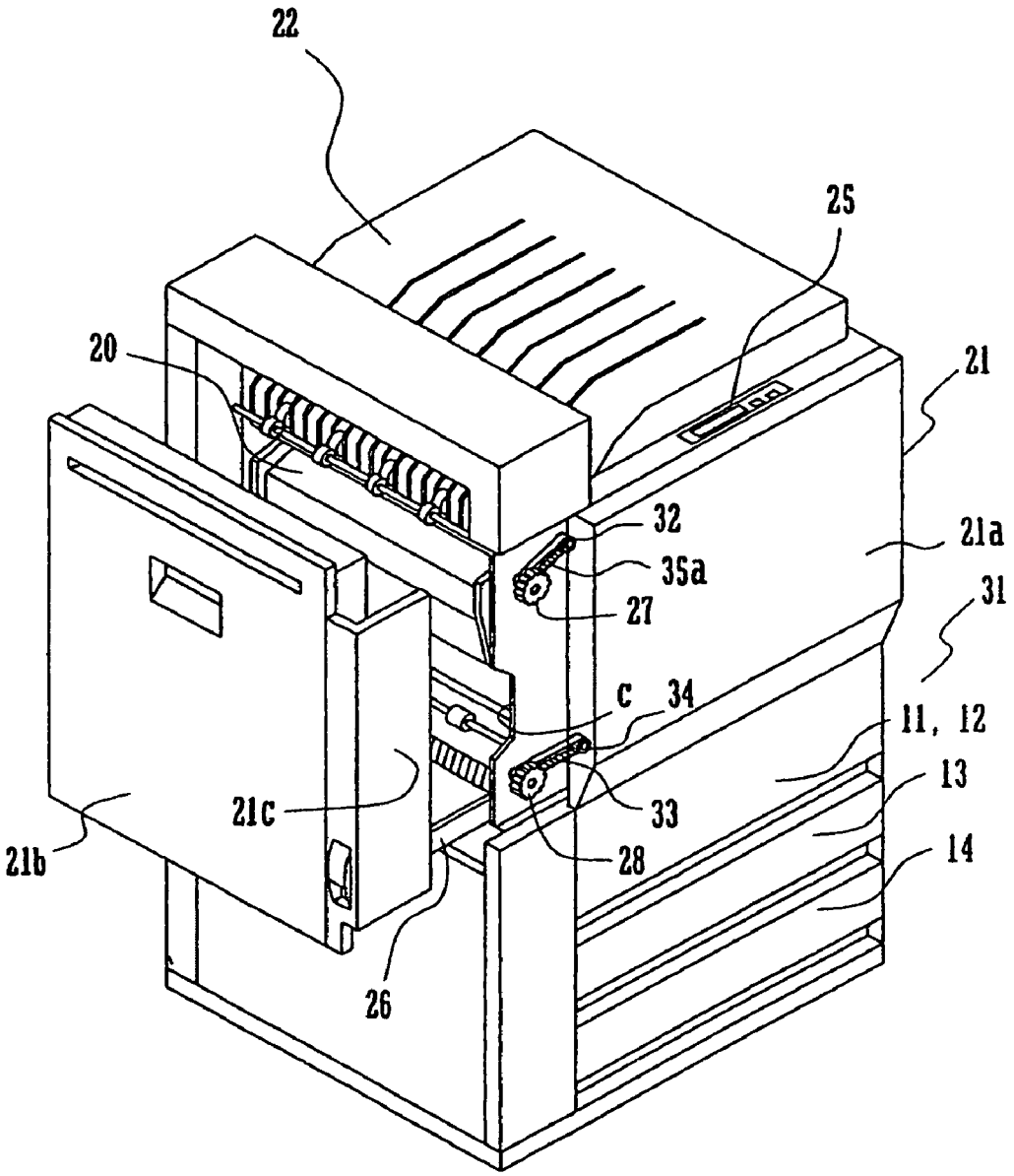
FIG. 4 is a perspective view showing a state in which a cover member in the image forming apparatus is removed.

As shown in FIG. 4, the upper knob 27 is connected in association with a fixing roller driving pulley 32 via an endless belt (i.e., transmitting means according to the present invention) 35*a*. The turning operation of the knob 27 enables the fixing roller (i.e., part of the transporting means according to the illustrated embodiment 20*a* to be turned both forward and reversely. Similarly, the lower knob 28 is connected in association with a registration roller driving pulley 34 via an endless belt (i.e., part of the transmitting means according to the illustrated embodiment 33. The turning operation of the knob 28 enables the registration roller pair 19 to be turned both forward and reversely.

In this manner, since the two knobs 27 and 28 are disposed, the knobs 27 and 28 are exposed forward of the apparatus body when the side cabinet 21*b* is withdrawn from the image forming apparatus 1 at the time of the jamming processing (i.e., the recovery operation) or the like. Consequently, an operator can readily operate forward the two knobs 27 and 28, and further, can readily operate both the knobs 27 and 28 even in the case where the side cabinet 21*b* is withdrawn from a side position.

Figure 5:
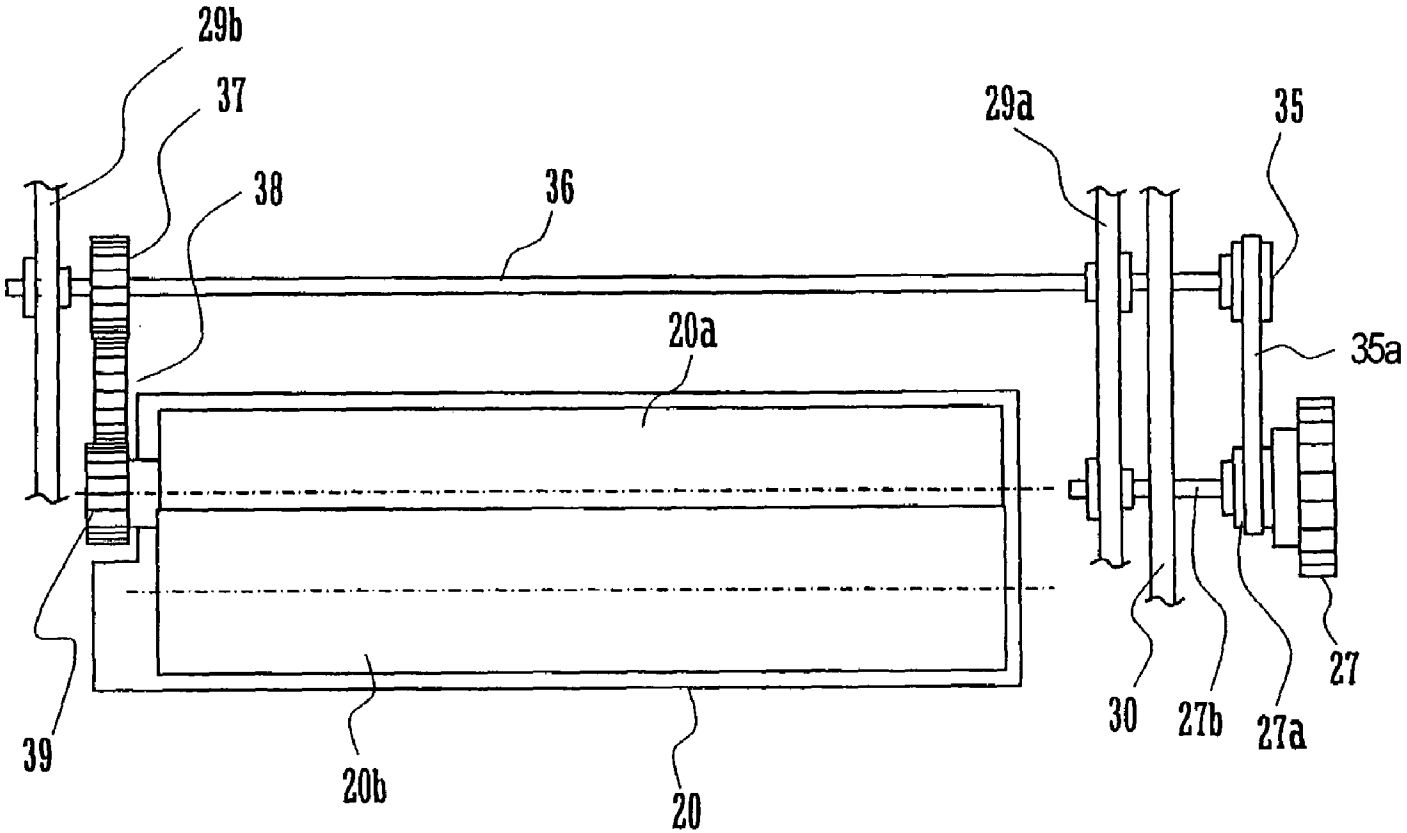
FIG. 5 is a view showing the configuration of transmitting means for connecting an operating member and a transporting member in association with each other.

FIG. 5 shows a drive mechanism for rotating the above-described fixing roller 20*a*. As shown in FIG. 5, a strut 27*b* of the upper knob 27 is turnably pivoted by the front frame member 29*a*, and further, a driving pulley 27*a* integrally formed inside of the knob 27 is connected in association with a driven pulley 35 via the endless belt 35*a*.

The driven pulley 35 is fixed to one end of a drive shaft 36 turnably pivoted by the front frame member 29*a* and a rear frame member 29*b*. Moreover, a first connecting gear 37 fixed to the other end of the drive shaft 36 is connected in association with a driven gear 39 secured to one end of the strut of the fixing roller 20*a* via a second connecting gear 38.

With this configuration, the knob 27 is turned forward or reversely, so that the fixing roller 20*a* can be turned both forward and reversely. Incidentally, as for the lower knob 28, a driving pulley, not shown, integrally formed inside of the lower knob 28 is connected in association with a registration roller driving pulley 34 via an endless belt 33, so that the registration roller pair 19 can be turned both forward and reversely by turning the lower knob 28 forward or reversely.

Since the upper knob 27 transmits drive force to a fixing roller rotation drive unit in the fixing unit 20 positioned behind the image forming apparatus 1 via the plurality of transmitting members (i.e., the transmitting means such as the gears, the drive shaft, the pulleys and the belts), as shown in FIG. 5, the image forming apparatus 1 hardly undergoes an adverse influence of heat generation from the fixing unit, thereby preventing any abnormal increase in temperature, so that the turning operation can be stably performed with ease.

Furthermore, a deceleration ratio in the drive force transmitting unit can be set such that the fixing roller 20*a* or the registration roller pair 19 can be manually rotated at small torque with ease by increasing the outer diameter of each of the knobs 27 and 28. Consequently, even in the case where a power source is connected to the fixing roller 20*a* or the registration roller pair 19, the fixing roller 20*a* or the registration roller pair 19 can be manually rotated with ease without separating the power source.

Here, if there is provided a mechanism for separating the power source in the case of the manual operation, operability can be enhanced more. Additionally, it is preferable that an easily gripped periphery, such as the illustrated example having substantially the shape of a star, should be formed on each of the knobs 27 and 28 in such a manner as to readily hook a finger, and further, that each of the knobs 27 and 28 should be formed in such a size as to be naturally grasped.

Since the knobs 27 and 28 are disposed outside of the front frame member 29*a*, the front frame member 29*a* is covered with the cover member 30 made of a resin, thereby effectively shielding radiant heat generated from the fixing unit 20 housed inside of the front frame member 29*a*, so as to effectively prevent any increase in temperature at the knob 27.

Although the image forming apparatus 1 shown in FIG. 1 is not provided with an image reading device for reading an original document and converting it into image data, the present invention may be directed to the configuration in which an image reading device is disposed above the image forming apparatus. In such a case, it may be configured such that operation of an image forming system is performed by an operating unit disposed on a front side of the image reading device.

In addition, the cabinet opening structure according to the present invention can be applied irrespective of the configuration, format, usage or the like as long as it is at least a cabinet in the apparatus having the transporting means for transporting the sheet member. Furthermore, the apparatus having the sheet member transporting means according to the present invention can be applied irrespective of the configuration, format, usage or the like as long as it is at least the apparatus provided with the operating member for manually turning the transporting means in the case where the portion parallel to the strut of the transporting member of the transporting means in the cabinet in the apparatus having the transporting means for transporting the sheet member is opened, and then, the sheet member is manually taken out of the apparatus.

As is clear from the above description, the present invention can produce the following effects.

When the jammed sheet member is taken out in the recovery operation in the case where the sheet member is jammed on the transportation path, and thus, stays inside of the apparatus, the operator can easily operate the operating member since the operator faces the operating member when the operator, for performing the recovery operation, opens the openable portion of the cabinet which is perpendicular to the side facing the operator. Moreover, the operator can easily operate the operating member since the operating member is not concealed by the openable portion but is exposed to the outside of the apparatus in the direction perpendicular to the opening direction even if the operator opens the openable portion forward at the position where the operator faces the openable portion of the cabinet.

Since the openable portion of the cabinet on the side perpendicular to the operating member includes a part of the cabinet on the side of the operating member, a part on the side of the operating member is opened by opening the openable portion, so that the operating member can be exposed on the side of the operating member, thereby facilitating the recovery operation.

When the jammed sheet member is taken out in the recovery operation by opening the openable portion of the cabinet in the case where the sheet member is jammed on the transportation path, and thus, stays inside of the apparatus, the operating member exposed to the outside of the frame member at the end of the frame member in the apparatus body can be easily operated, thereby performing the jamming processing with good workability. That is to say, the operator who performs the recovery operation can easily operate the operating member since the operator faces the operating member even if the operator opens the openable portion of the cabinet on the side perpendicular to the side facing the apparatus. Moreover, the operator can easily operate the operating member since the operating member cannot be concealed by the openable portion but is exposed to the outside in the direction perpendicular to the opening direction of the openable portion even if the operator opens the openable portion forward at the position where the operator faces the openable portion.

Since the transporting unit is connected to the operating member via the plurality of transmitting members, the operating member can be set at the position easy to be operated, remote from the transporting member in the transporting unit.

The registration roller pair for transporting the sheet member while holding it by the strong force and the fixing roller can be manually driven independently of each other by operating the first and second operating members, and therefore it is possible to take out the sheet recording member staying inside of the image forming apparatus due to the trouble such as the transportation jamming.

It is to be understood that the present invention is not restricted to the particular preferred embodiment given above, and that various modifications and alterations can be added thereto without departing from the scope of the present invention.

What is claimed is:

1. A cabinet opening structure for an apparatus having a sheet transporting member comprising:

a side cabinet having a portion which can be opened in a first direction; the side cabinet having a front flange;

first and second operating members connected to the transporting member which can be manually operated for operating the sheet transporting member;

wherein; the first and second operating members are concealed when the side cabinet is closed and the first and second operating members are exposed when the side cabinet is in the open position said operating members being disposed at a position at which said operating members are exposed to the outside of the apparatus in a direction perpendicular to the first direction when said openable portion of the cabinet is opened.

2. The cabinet opening structure according to claim 1, wherein the openable portion of the cabinet is disposed on a side of the cabinet generally perpendicular to the front of the cabinet the apparatus further comprising an operating unit for operating the apparatus positioned adjacent the front of the cabinet, wherein the operating member is exposed to the front of the apparatus.

3. The cabinet opening structure according to claim 2, wherein the openable portion of the cabinet includes a part of the cabinet on the same side of the apparatus as the operating unit.

4. The cabinet opening structure according to claim 1, wherein there is a cover with an opening so that the operating member is exposed to the outside of the cover.

5. The cabinet opening structure according to claim 4, wherein the operating member has a star shape.

6. An apparatus provided with a sheet member transporting unit, comprising:

a transporting unit for transporting a sheet member;

a side cabinet having a portion which can be opened in a first direction from the body of the apparatus; and an operating member connected to the transporting unit which can be manually operated;

the operating member being disposed at a position, at which the operating member is exposed to the outside of the apparatus body in a direction perpendicular to the first opening direction when the openable portion of the cabinet is opened from the apparatus body, said operating member being located generally along a transportation path of a sheet member in the apparatus first and second operating members connected to the transporting member which can be manually operated for operating the sheet transporting member;

wherein; the first and second operating members are concealed when the side cabinet is closed and the first and second operating members are exposed when the side cabinet is in the open position said operating members being disposed at a position at which said operating member is exposed to the outside of the apparatus in a direction perpendicular to the first direction when said openable portion of the cabinet is opened.

7. The apparatus provided with a sheet member transporting unit according to claim 6, further comprising an apparatus operating unit for operating the apparatus disposed on the same side of the apparatus on which the operating member is exposed.

8. The apparatus provided with a sheet member according to claim 6, wherein the transporting unit is connected to the operating member via a plurality of transmitting members.

9. The apparatus according to claim 6, wherein the operating member is located in proximity to an end frame member of the apparatus.

10. The apparatus according to claim 6, wherein there is a cover with an opening so that the operating member is exposed to the outside of the cover.

11. The apparatus according to claim 10, wherein the operating member has a star shape.

12. An image forming apparatus comprising:

a transporting unit for transporting a sheet member;

an image forming unit for forming an image on the sheet member based on image information;

a fixing device for fixing the image formed on the sheet member in the image forming unit;

a side cabinet for the apparatus having a portion which is openable in a first direction;

a first operating member connected to the transporting unit; which can be manually operated; and a second operating member connected to the fixing device which can be manually operated;

wherein, the first and second operating members being disposed at positions at which the operating members are exposed to the outside of the apparatus in a direction perpendicular to the first opening direction when the openable portion of the side cabinet is opened and the first and second members are concealed when the side cabinet is in a closed position.

13. The image forming apparatus according to claim 12, wherein the transporting unit includes a registration roller pair for controlling a timing when the sheet member is transported with respect to the image forming unit;

the fixing device includes a fixing roller for holding the sheet member with the application of heat under pressure so as to fix the image formed on the sheet member; and the first operating member is connected to the registration roller pair in the transporting unit while the second operating member is connected to the fixing roller in the fixing device.

14. The image forming apparatus according to claim 12, wherein the first and second operating members are located in proximity to an end frame member of the apparatus.

15. The image forming apparatus according to claim 12, wherein there is a cover with an opening so that the operating members are exposed to the outside of the cover.

16. The image forming apparatus according to claim 15, wherein the operating members have a star shape.

* * * * *